US007861883B2

(12) United States Patent
Purushothaman

(10) Patent No.: US 7,861,883 B2
(45) Date of Patent: Jan. 4, 2011

(54) ARTICLE BASKETS FOR A DISHWASHER

(75) Inventor: Balaji Purushothaman, Evans, GA (US)

(73) Assignee: Electrolux Home Products, Inc., Cleveland, OH (US)

( * ) Notice: Subject to any disclaimer, the term of this patent is extended or adjusted under 35 U.S.C. 154(b) by 199 days.

(21) Appl. No.: 11/504,841

(22) Filed: Aug. 16, 2006

(65) Prior Publication Data

US 2007/0039971 A1 Feb. 22, 2007

Related U.S. Application Data

(60) Provisional application No. 60/708,887, filed on Aug. 17, 2005.

(51) Int. Cl.
*B65D 6/08* (2006.01)

(52) U.S. Cl. ..... 220/488; 220/676; 220/529; 206/553

(58) Field of Classification Search ..... 220/676, 220/762, 607, 487, 488, 735, 736, 554, 535, 220/510, 512, 529, 532; 248/37.3; 206/553
See application file for complete search history.

(56) References Cited

U.S. PATENT DOCUMENTS

| | | | | | |
|---|---|---|---|---|---|
| 514,488 | A | * | 2/1894 | Moore | 294/143 |
| 981,744 | A | * | 1/1911 | Bowditch | 229/120.32 |
| 1,509,549 | A | * | 9/1924 | Freeland | 220/623 |
| 2,060,468 | A | * | 11/1936 | Mitchell | 220/676 |
| D129,403 | S | * | 9/1941 | Sedgwick | D3/309 |
| 2,510,211 | A | * | 6/1950 | Cleary | 229/120.32 |
| 2,676,728 | A | * | 4/1954 | Smith | 220/503 |
| 2,815,863 | A | * | 12/1957 | Larson | 211/70.1 |
| 2,979,844 | A | * | 4/1961 | Lattuca | 220/754 |
| 3,050,073 | A | * | 8/1962 | McMillan | 134/137 |
| 3,182,854 | A | * | 5/1965 | Geller | 220/676 |
| 3,236,410 | A | * | 2/1966 | Swartz | 220/62 |
| 3,294,308 | A | * | 12/1966 | Tress et al. | 206/521 |
| 3,655,114 | A | * | 4/1972 | Turner | 220/7 |
| 3,665,943 | A | * | 5/1972 | Lampman et al. | 134/200 |
| 3,935,958 | A | * | 2/1976 | Frangos | 220/488 |
| 3,960,290 | A | * | 6/1976 | Yake et al. | 220/835 |
| 4,157,145 | A | * | 6/1979 | Jordan | 220/487 |
| D254,187 | S | * | 2/1980 | Freese | D32/3 |
| 4,192,432 | A | * | 3/1980 | Jordan | 220/676 |
| 4,193,588 | A | | 3/1980 | Doneaux | |
| 4,318,478 | A | * | 3/1982 | De Winter | 206/553 |
| 4,339,051 | A | * | 7/1982 | Crawford | 220/607 |

(Continued)

*Primary Examiner*—Anthony Stashick
*Assistant Examiner*—Christopher B McKinley
(74) *Attorney, Agent, or Firm*—Pearne & Gordon LLP

(57) ABSTRACT

Article baskets are adapted to support articles within a dishwashing machine. The article baskets can include an article support wall with a plurality of openings defined by an edge extending along a path circumscribing substantially the entire opening. If provided, the edge of each of the openings can be concave in a direction facing the opening along substantially the entire path. In addition, or alternatively, the article basket can further include a divider. The divider can include a portion configured to be selectively inserted into a elongated slot of a sidewall to divide the interior area into a first interior area portion and a second interior area portion. In addition, or alternatively, the divider can include a plurality of article receiving openings with at least one protrusion extending partially across the article receiving opening to divide a plurality of articles.

21 Claims, 5 Drawing Sheets

U.S. PATENT DOCUMENTS 4,867,332 A * 9/1989 Mains ..... 220/735
D304,116 S * 10/1989 Jun ..... D34/28
4,951,866 A * 8/1990 Rusnak ..... 229/120.07
4,972,955 A * 11/1990 Rymoen ..... 206/553
5,012,971 A * 5/1991 Cozzi et al. ..... 229/120.07
5,069,360 A * 12/1991 Dingler et al. ..... 220/501
5,092,463 A * 3/1992 Dees ..... 206/373
5,213,256 A * 5/1993 Cyr ..... 229/120.32
D338,749 S 8/1993 McConnell
5,287,984 A * 2/1994 Michael ..... 220/812
5,333,751 A * 8/1994 Santucci, Sr. ..... 206/423
5,385,261 A * 1/1995 Lippisch et al. ..... 220/572
5,431,294 A * 7/1995 Stottmann et al. ..... 220/23.4
5,605,056 A * 2/1997 Brown et al. ..... 62/457.4
D391,696 S * 3/1998 Bournay et al. ..... D32/3
5,881,906 A * 3/1999 Rogers et al. ..... 220/607
6,089,375 A * 7/2000 Johnson et al. ..... 206/541
6,161,718 A * 12/2000 Monbo ..... 220/486
6,357,645 B1 * 3/2002 Keefe ..... 224/567
6,412,735 B1 * 7/2002 Mathieu ..... 248/110
D471,679 S * 3/2003 Henzey ..... D32/3
D473,985 S * 4/2003 Moreira Da Silva ..... D32/32
6,602,528 B1 * 8/2003 Wells ..... 426/120
D481,179 S 10/2003 Wendt et al.
6,659,406 B2 * 12/2003 Tsuchida ..... 248/37.3
D487,825 S * 3/2004 Kim et al. ..... D32/3
D488,891 S * 4/2004 Smith et al. ..... D32/3
D489,960 S * 5/2004 Grendahl ..... D8/354
D501,125 S * 1/2005 Winig et al. ..... D8/71
D502,295 S * 2/2005 Feddema ..... D32/3
6,857,526 B2 * 2/2005 Vollmer ..... 211/65
D502,638 S * 3/2005 Winig et al. ..... D8/71
6,868,977 B2 * 3/2005 Rosenbauer et al. ..... 211/41.9
6,945,421 B2 * 9/2005 Phifer ..... 220/486
D517,253 S * 3/2006 Raches et al. ..... D32/3
7,267,238 B2 * 9/2007 Yang et al. ..... 211/41.3
2002/0139809 A1 * 10/2002 Barry et al. ..... 220/762
2004/0031508 A1 2/2004 Rosenbauer et al.
2004/0079713 A1 4/2004 Wendt et al.
2004/0094555 A1 * 5/2004 Raches et al. ..... 220/476

* cited by examiner

ARTICLE BASKETS FOR A DISHWASHER

CROSS-REFERENCE TO RELATED APPLICATION

The present invention claims the benefit of U.S. Provisional Application No. 60/708,887 filed Aug. 17, 2005, the entire disclosure which is herein incorporated by reference.

FIELD OF THE INVENTION

The present invention relates to baskets for supporting articles and more particularly to articles baskets for a dishwasher.

BACKGROUND OF THE INVENTION

Conventional dishwashers typically include dishwasher racks adapted to support articles during a dishwashing cycle. For example, conventional racks may support pots, pans, plates, bowls, utensils, glassware, drinking vessels (e.g., cups, mugs, glasses, stemware) or other kitchenware. Dishwasher racks frequently include a conventional article basket to provide alternative support for articles, such as utensils, within an interior area of a dishwasher. There is a need for article baskets to support articles for cleaning during a dishwashing procedure.

SUMMARY OF THE INVENTION

It is an aspect of the present invention to provide article baskets adapted to support articles within a dishwashing machine for cleaning during a dishwashing procedure.

In accordance with one aspect, an article basket is adapted to support articles within a dishwashing machine. The article basket comprises an article support wall configured to support articles extending within an interior area of the basket. The article support wall is provided with a plurality of openings extending through the article support wall. Each of the openings is defined by an edge extending along a path circumscribing substantially the entire opening. The edge of each of the openings is concave in a direction facing the opening along substantially the entire path. The openings are configured to permit permeation of fluid through the article support wall while inhibiting passage of supported articles through the article support wall.

In accordance another aspect, an article basket is configured for supporting articles within a dishwashing machine. The article basket comprises at least one side wall at least partially defining an interior area of the basket and including an elongated slot. The article basket further includes a divider including a portion configured to be selectively inserted into the elongated slot to divide the interior area into a first interior area portion and a second interior area portion.

In accordance still another aspect, an article basket is provided for supporting articles within a dishwashing machine. The article basket comprises at least one side wall at least partially defining an interior area of the basket. The article basket further includes a divider configured to extend over an opening into the interior area of the basket. The divider includes a plurality of article receiving openings configured to receive a portion of an article being inserted into the interior area of the basket. Each of the article receiving openings includes at least one protrusion extending partially across the article receiving opening.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
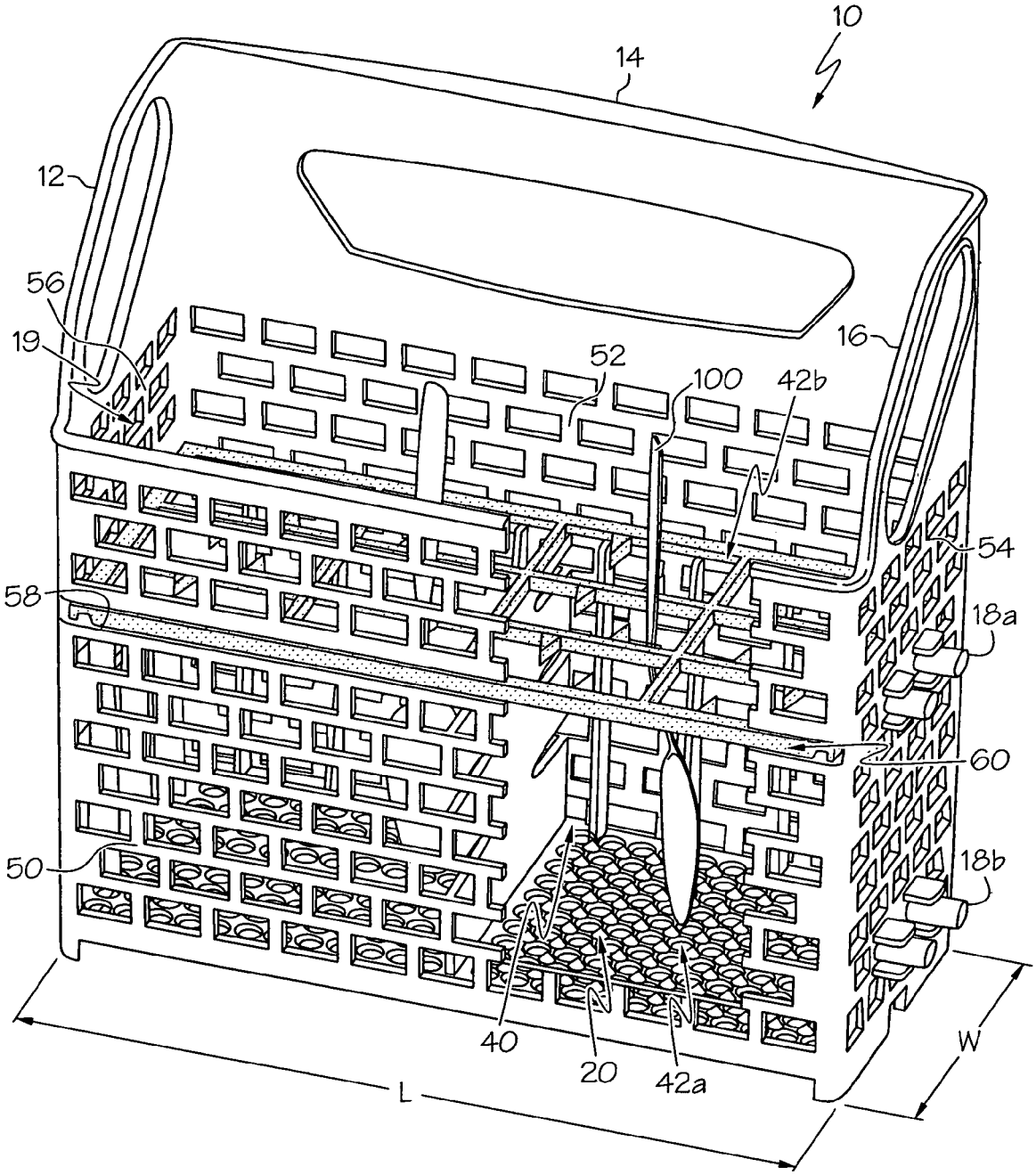
FIG. 1 depicts a perspective view of an article basket in accordance with one example of the present invention with portions of a first side wall shown broken away to reveal portions of an interior area of the article basket.

Certain terminology is used herein for convenience only and is not to be taken as a limitation on the present invention. Further, in the drawings, the same reference numerals are employed for designating the same elements.

FIG. 1 depicts an article basket 10 for a dishwasher. Article baskets in accordance with the present invention may be used to receive and support a wide range of articles. For example, article baskets may be designed to receive and support dishware items such as utensils (e.g., knives, forks, spoons, spatulas, etc.), drinking vessels (e.g., cups, mugs, glasses, stemware, etc.) or other kitchenware or the like. Moreover, article baskets herein may be used in a wide variety of ways before, during and/or after the dishwashing cycle.

Figure 6:
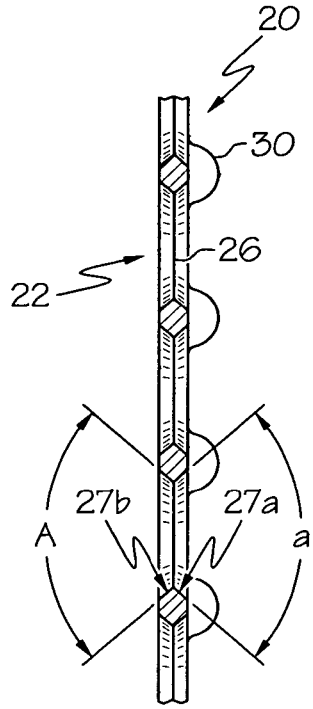
FIG. 6 is a sectional view of the article support wall taken at line 6-6 of FIG. 4.

FIG. 1 depicts a perspective view of an article basket 10 in accordance with example aspects of the present invention. The article basket 10 can include an article support wall 20 configured to support articles extending within an interior area 40 of the basket 10. As shown, the articles can comprise a spoons 100 although, knives, forks, and/or other articles may be supported in further examples. In one example, the article support wall 20 is provided with a plurality of openings 22 extending through the article support wall 20. Each of the openings 22 can be defined by an edge 26 extending along a path (28, see FIG. 4) circumscribing substantially the entire opening 22. As shown, the path 28 circumscribes the entire opening 22 although it is contemplated that the path 28 may circumscribe less than the entire opening 22 while still circumscribing substantially the entire opening 22. As shown in FIG. 6, the edge 26 can comprise a pointed edge although the edge may comprise blunted or other edge types in further examples. For example, although not shown, the edge may comprise a cylindrical surface or may comprise a rounded profile or other shape.

Furthermore, as shown in the example, the edge 26 of each of the openings can be concave in a direction 29 facing the opening 22 along substantially the entire path 28. As further shown, the path 28 can comprise a circular path although other shaped paths may be used in further examples. For instance, although not shown, the path may have an oval shape while still being concave in the direction facing the opening along substantially the entire path. In still further examples, the paths may have shapes other than a circular or oval shape. Providing a circular shape can be beneficial to permit permeation of fluid through the article support wall 20 while inhibiting passage of articles 100 through the article support wall 20. In one example, the circular openings 22 can help inhibit passage of the tines of a fork through the article support wall 20.

Figure 4:
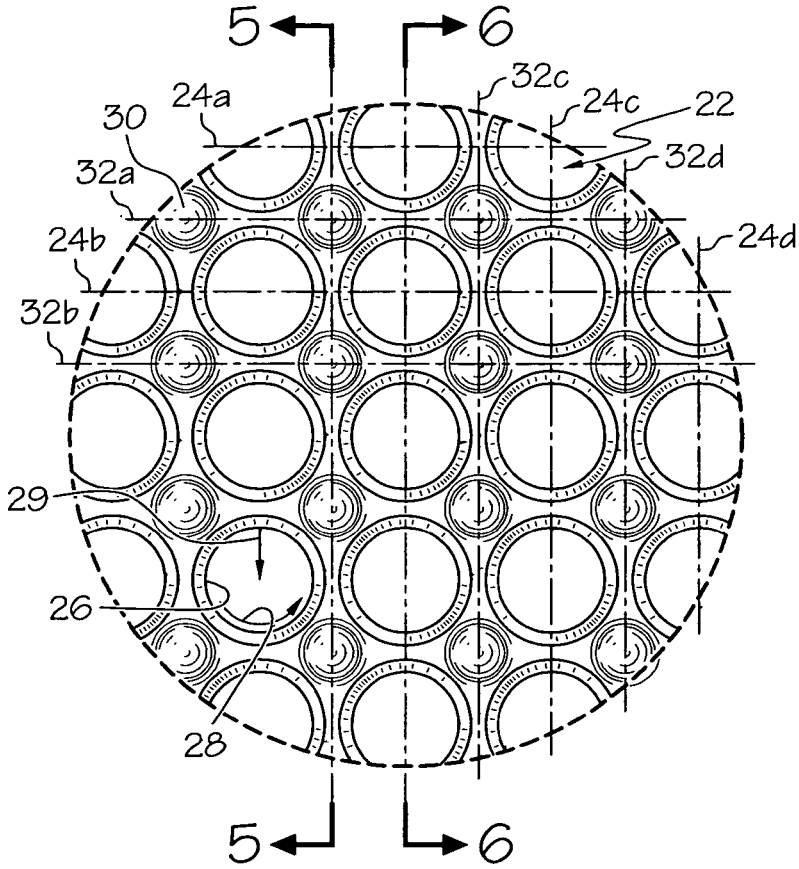
FIG. 4 is an enlarged view of portions of an article support wall taken at view 4 of FIG. 3.

In further examples, each opening 22 can be provided with at least one conical surface circumscribing substantially the entire opening. In one example, a single conical surface is provided although a plurality of conical surfaces may be provided in further examples. For instance, as shown in FIGS. 4 and 6, the each opening can be provided with a first conical surface 27*a* facing towards the interior area 40 of the article basket 10 and a second conical surface 27*b* facing away from the interior area 40 of the article basket 10. Although not required, as shown, the conical surfaces 27*a*, 27*b* can meet to define the edge 26. The second conical surface 27*b* can help funnel cleaning fluid into the interior area 40 of the article basket 10 during the dishwashing cycle. Moreover, the second conical surface 27*b*, in conjunction with the circular path 28 circumscribing substantially the entire opening 22 can help form a jet stream to increase the cleaning action of the cleaning fluid during the dishwashing cycle. Moreover, the first and second conical surfaces 27*a*, 27*b* can work together to help pull liquid off the articles 100 as the articles are drying after the washing cycle. Indeed, rinse water or other fluid will tend to flow down the first conical surface 27*a*, about the pointed edge 26 and then down and away from the supported articles by flowing down the second conical surface 27*b*. The conical surfaces 27*a*, 27*b*, if provided, can have the same or different taper angles. As shown in FIG. 6, the taper angles "A" and "a" are approximately 90° although other angles may be used in further examples.

The openings 22 can be arranged in a wide variety of patterns along the article support wall 20. As shown in FIG. 4, for example, the openings can be arranged as a matrix of openings 22 along a plurality of opening row paths 24*a*, 24*b* and a plurality of opening column paths 24*c*, 24*d* that are substantially perpendicular to the opening row paths. Such a configuration can enhance permeation of fluid through the support wall 20 while frustrating passage of supported articles 100 through the article support wall 20.

Figure 5:
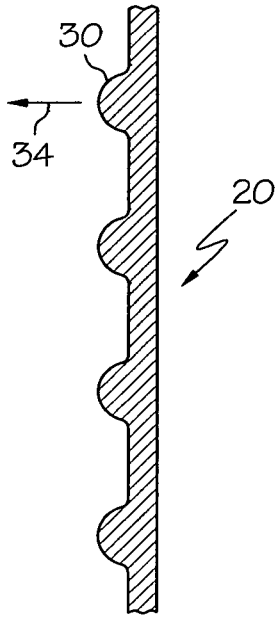
FIG. 5 is a sectional view of the article support wall taken at line 5-5 of FIG. 4.

The article support wall 20 can also include a plurality of protrusions 30 that each extend in a direction 34 (see FIG. 5) towards the interior area 40 of the article basket 10. The protrusions can interact with portions of supported articles to help inhibit, such as prevent, sliding an nesting of articles supported with the article basket 10. For example, a plurality of protrusions 30 may provide seating locations for the tips of silverware or other articles supported by the article basket to help separate the supported silverware. Separating the silverware can help maximize the surface area of the silverware exposed to cleaning fluid during a dishwashing procedure. Moreover, separating the silverware can help circulate air over a larger surface area of the silverware; thereby reducing the duration of the drying cycle.

The protrusions 30, if provided, can comprise a wide variety of shapes and sizes depending on the particular application. In the illustrated example, the protrusions 30 comprise a substantially hemispherical protrusion although other shapes may be used in further examples. Providing the protrusions as hemispherical protrusions can reduce stress points on the protrusion, thereby reducing the probability of protrusion damage and increasing the useful life of the article basket. Moreover, the gradual sloping shape provided by the hemisphere discourages the articles from resting on top of the protrusions 30. Rather, the protrusions 30 can act as spacers by encouraging the supported articles to fall to an area away from the apex of the protrusions 30. Although not shown, the protrusions can comprise other shapes such as conical or other geometrical shape.

As shown in the illustrated example, the protrusions 30 can optionally be arranged as a matrix of protrusions 30 along a plurality of protrusion row paths 32*a*, 32*b* and a plurality of protrusion column paths 32*c*, 32*d* that are substantially perpendicular to the protrusion row paths. Arranging the protrusions 30 as a matrix of protrusions can provide multiple, spaced-apart seating locations for spaced apart articles supported by the article support wall 20. The matrix of protrusions 30 can also be arranged with respect to the matrix of openings 22 such that each protrusion row path 32*a*, 32*b* extends between a pair of adjacent opening row paths 24*a*, 24*b* and each protrusion column path 32*c*, 32*d* extends between a pair of adjacent opening column paths 24*c*, 24*d*. Arranging the matrix of protrusions with respect to the matrix of openings in this manner helps maximize the amount of opening space to receive cleaning fluid during the washing cycle and also encourages the ends of the supported articles 100 to rest in the vicinity of the openings 22. Since the ends of the supported articles 100 are resting over or near the openings 22, rinse water or other fluid will tend to be pulled away from the supported articles by the first and second conical surfaces 27*a*, 27*b*. Thus the above-referenced arrangement of the matrix of protrusions 30 with respect to the matrix of openings 22 can reduce the drying time for the supported articles 100.

The article basket can comprise at least one side wall at least partially defining the interior area of the basket. For example, as shown in FIG. 1, the article basket 10 includes a first side wall 50 and a second side wall 52 spaced from the first sidewall 50 to define a width "W" of the article basket 10. The illustrated article basket 10 further includes a third side wall 54 and a fourth side wall 56 spaced from the third side wall 54 to define a length "L" of the article basket 10. As shown, the article basket 10 can comprise an rectangular shaped basket with four side walls 50, 52, 54, 56 extending from the article support wall 20. The article support wall 20 defines a lower boundary of the interior area 40 of the article basket 10, while the side walls 50, 52, 54, 56 define the lateral boundaries of the interior area 40 of the article basket 10 and also define an article insertion opening 19 into the interior area 40. It will be appreciated that the at least one side wall can comprise three or more than four sides in further examples.

Figure 3:
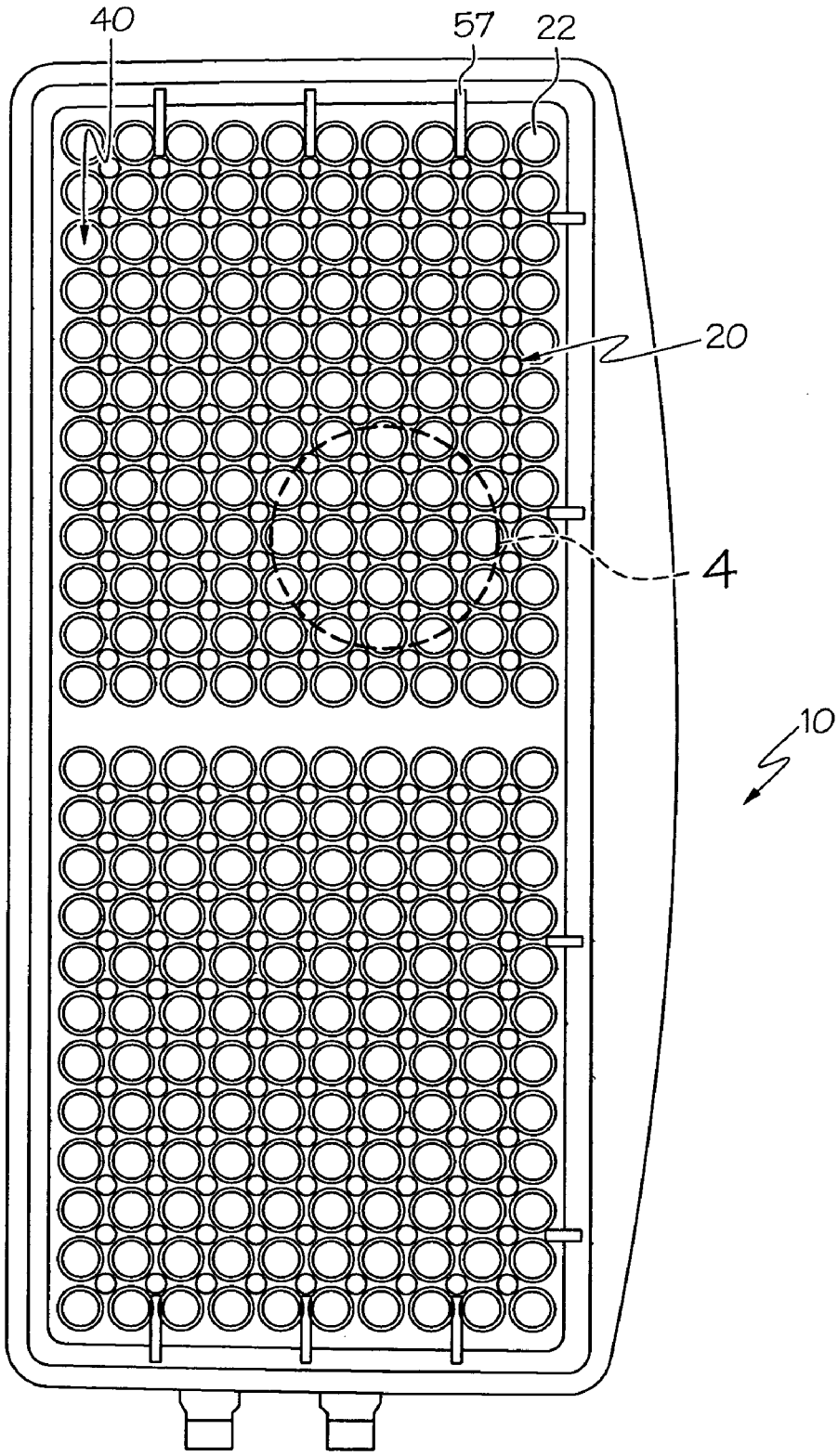
FIG. 3 is a top view of the article basket of FIG. 1 with the divider removed.

The sidewalls may include structure configured to facilitate removal of the article basket 10 from the dishwasher rack and/or cooperation between a plurality of article baskets 10. For example, as shown, the at least one side wall can include one or more handles 12, 14, 16 configured to facilitate removal of the article basket 10 from the dishwasher rack. As shown in FIGS. 1 and 3, the rear handle 14 can have an increased width to facilitate grasping and lifting of the article basket. Moreover, the at least one side wall can include one or more coupling structures 18*a*, 18*b* configured to link a plurality of article baskets together along a periphery of the dishwasher rack. The coupling structures 18*a*, 18*b*, if provided can allow a wide range of article basket configurations. For instance, the coupling structures 18*a*, 18*b* may allow two or more article baskets 10 to be linearly linked in series along a side of a dishwasher rack. In another example, a corner basket may be linked between two article baskets 10 oriented at 90° relative to one another such that the article baskets each extend along a corresponding side of a dishwasher rack and through an intermediate corner of the dishwasher rack linking the dishwasher rack sides.

Figure 2:
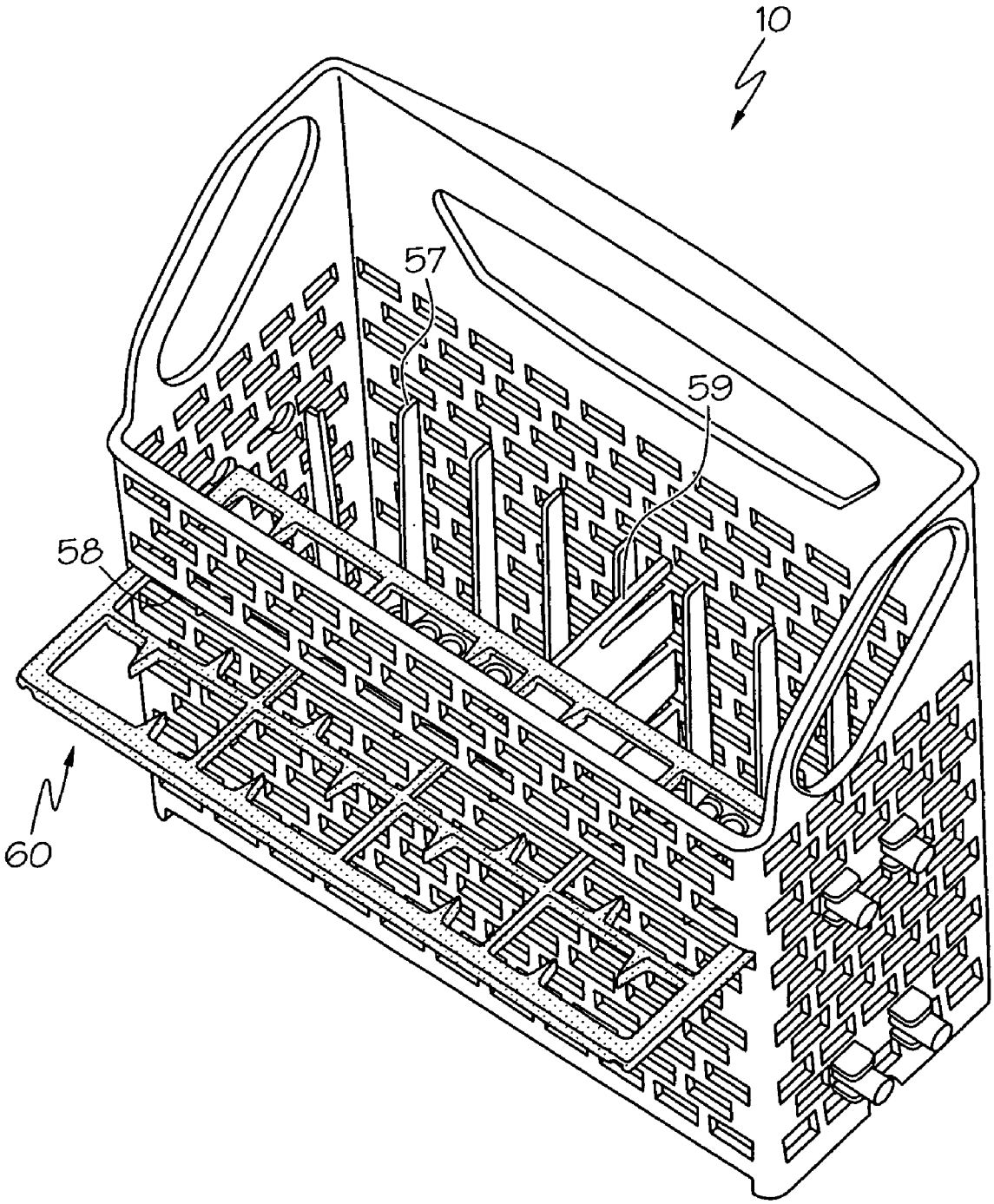
FIG. 2 is another perspective view of the article basket of FIG. 1 with a portion of a divider being received by a slot in the first side wall of the article basket.
Figure 7:
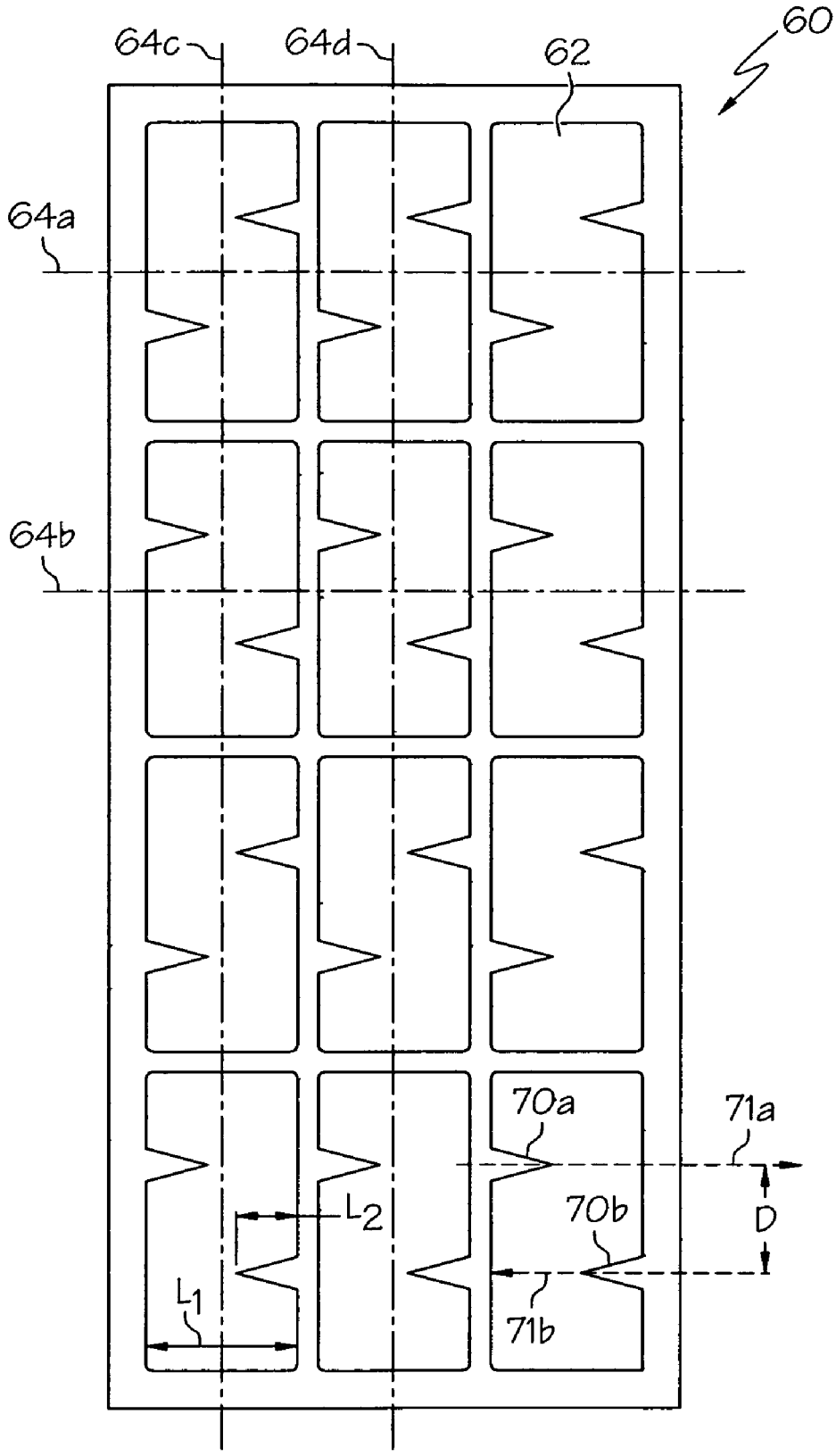
FIG. 7 is a top view of a divider in accordance with an example of the present invention.

As shown in FIGS. 1, 2 and 7, further examples of the article basket can include one or more optional dividers 60. The divider 60 can optionally act to divide the interior are 40 into a first interior area portion 42*a* and a second interior area portion 42*b*. As shown, the first interior area portion 42*a* can be defined by the article support wall 20, the divider 60 and the at least one side wall 50, 52, 54, 56. The second interior area portion 42*b* can be defined by the at least one sidewall 50, 52, 54, 56 and the divider 60 while being open to the article insertion opening 19.

In such an example, the divider 60 can act as a lid for the first interior area portion 42*a* to help restrain articles from exiting the interior of the article basket 10. For example, relatively small, lightweight articles may be placed in the first interior area portion 42*a* to be washed without being removed from the dishwasher rack and being subsequently exposed to a heating element of the dishwasher. The divider 60 can also act as a shelf for additional articles being supported in the second interior area portion 42*b*. For example, cups, mugs or other articles may be placed on the divider 60 for support within the second interior area portion 42*b*. In such an example, utensils (e.g., knives, forks, spoons, etc.) may be supported with the article basket 10 while mugs, cups or other beverage containers may rest inverted on the divider 60. Handles or other portions of the utensils extending from the divider 60 can be received within the interior area of cups, mugs or other beverage containers that are supported on the divider 60 in an inverted orientation.

The at least one sidewall 50, 52, 54, 56 can also include an elongated slot 58 for the divider 60. As shown in FIGS. 1 and 2, a portion of the divider 60 to be selectively slidably inserted into the elongated slot 58 to divide the interior area 40 into the first interior area portion 42*a* and the second interior area portion 42*b*. In the illustrated example, the first side wall 50 includes the elongated slot 58 although the elongated slot may be provided in any of the sidewalls of the article basket 10 in further examples. Moreover, as shown, the elongated slot 58 extends along substantially the entire length "L" of the article basket 10 to permit the divider to substantially segregate the entire interior area 40 into the first and second interior area portions 42*a*, 42*b*. It will be appreciated that the elongated slot 58 permits the divider 60 to be inserted laterally into the article basket 10 and allows the divider 60 to be removed from the interior 40 of the article basket 10 without passing through the article insertion opening 19.

The article basket 10 can also include support structure configured to support the divider 60. For example, as shown in FIGS. 2 and 3, the article basket 10 can include support structure 57 extending from one or more of the side walls 50, 52, 54, 56 and configured to support a peripheral portion of the divider 60. A dividing support structure 59 may also be provided to support an intermediate portion of the divider 60. The dividing support structure 59, if provided, can also be configured to segregate the first interior area portion 42*a* into laterally disposed subportions. The support structures 57, 59 can allow the divider 60 to support increased weight loads when the divider is acting as a shelf for other articles, such as beverage containers and the like.

As mentioned above, the one or more dividers 60, if provided, can act to divide the interior area 40 into the first interior area portion 42*a* and the second interior area portion 42*b*. In addition, or alternatively, the one or more dividers 60 can act to divide a reception area into a plurality of reception areas that are each configured to receive one or more of the plurality of supported articles 100. As shown in FIG. 7, the divider 60 can include a plurality of article receiving openings 62 configured to receive a portion of an article 100 being inserted into the interior area 40 of the article basket 10. Each of the article receiving openings 62 can include at least one protrusion 70*a*, 70*b* extending partially across the article receiving opening 62. The at least one protrusion 70*a*, 70*b* can act as a seating area for one or more portions of the supported articles 100 to allow the intermediate portion of the articles to be spaced in various positions within the article receiving openings 62. Locating the intermediate portion of the articles at different positions within the article receiving openings 62 can help maximize the surface area of the silverware or other supported articles exposed to cleaning fluid during the dishwashing procedure. Moreover, separating the silverware or other supported articles can help circulate air over a larger surface area of the articles; thereby reducing the duration of the drying cycle. Still further, the at least one protrusion 70*a*, 70*b* together with the protrusions 30 and openings 22 of the article support wall 20 can work together to provide enhanced separation of the silverware or other supported articles to increase the effectiveness of the washing and drying procedures.

As shown in the example of FIG. 7, each article receiving opening 62 can include a pair of protrusions 70*a*, 70*b* although a single or three or more protrusions may be provided in further examples. Each of the protrusions can extend in the same direction or can extend in different directions. For example, as shown, the first protrusion 70*a* extends in a first direction 71*a* and the second protrusion 70*b* extends in a second direction 71*b* that is opposite to the first direction 71*a*. Furthermore, as shown, the first protrusion 70*a* can extend along a first axis (see 71*a* generally) and the second protrusion 70*b* can extend along a second axis (see 71*b* generally) that is spaced a distance "D" from the first axis. Spacing the first and second axis from one another can provide alternate seating locations along a dimension of the article receiving opening 62. Moreover, extending the protrusions 70*a*, 70*b* long opposite directions can provide multiple seating locations for supported articles leaning towards one or the other side of the article receiving opening 62. The protrusions can also be designed to help automatically segregate articles being inserted through the article openings 62. For example, as shown, the protrusions 70*a*, 70*b* can comprise a substantially V-shaped profile although other profile shapes may be provided in further examples. The V-shaped profile can encourage some of the supported articles to fall from the seat provided by the protrusions 70*a*, 70*b*. Thus, a significant nesting of supported articles is discouraged at each seating location defined by the protrusions 70*a*, 70*b*.

As further shown, example protrusions can extend a length "$L_2$" that is less than about 50% of a length "$L_1$" of the article receiving opening 62 although greater lengths of up to less than 100% of the Length "$L_1$" of the article receiving opening 62 is contemplated in further examples. Providing the protrusions 70*a*, 70*b* with a length "$L_2$" that is less than about 50% of the length "$L_1$" of the article receiving opening 62 can further discourage significant nesting of supported articles at particular seating locations defined by the protrusions 70*a*, 70*b*. Furthermore, providing the protrusions 70*a*, 70*b* with a length "$L_2$" that is less than about 50% of the length "$L_1$" of the article receiving opening 62 together with protrusions 70*a*, 70*b* having a substantially V-shaped profile can help distribute the portions of the supported articles extending through the article receiving openings 62. For example, due to the V-shaped profile of the protrusions 70*a*, 70*b*, handles of the articles extending through the opening may begin to slide off of one protrusion 70*a* in a direction towards the other side of the article receiving opening 62. The second protrusion 70*b* can then catch the handle of the article as it ramps off the first protrusion 70*a*.

The article receiving openings 62 are illustrated as rectangular although other shapes and sizes may be provided in further examples. As shown, the article receiving openings 62 can be shaped to receive ends of spoons and forks and other utensils. Thus, articles 100 may be loaded with the handles extending upwards and the working portion of the utensils (e.g., scoop portion of a spoon, tine portion of a fork, cutting edge of a knife, etc.) facing downwards. Such an orientation may be desirable to prevent human contact with the sanitized working portions of the utensils that will subsequently come into contact with a users food or a users mouth in use. Thus, the divider 60 in accordance with examples of the present invention can support utensils with the handles exposed for subsequent grasping when a user unloads the dishwasher after the dishwashing cycle.

The plurality of article receiving openings 62 of the divider 60 can be arranged with a wide variety of patterns. In one example, the divider 60 includes a framework of ribs which are arranged perpendicular to one another to form a lattice of rectangular openings 62 to maximize the reception area for the articles. Although not required, as shown in FIG. 7, the article receiving openings 62 can also be arranged as a matrix of article receiving openings along a plurality of row paths 64*a*, 64*b* and a plurality of column paths 64*c*, 64*d* that are substantially perpendicular to the row paths 64*a*, 64*b*. Providing such a matrix of article receiving openings 62 can help maximize the reception area for articles when used with a rectangular article basket having four sides 50, 52, 54, 56.

In use, a user may decide to provide the article basket 10 with a divider 60 to divide the interior area 40 into a first interior area portion 42*a* and a second interior area portion 42*b*. Next, a user may decide to insert a plurality of silverware items with the working portion facing downwards. The second area 42*b* receives the working portion of the silverware and some of the silverware will immediately be received through one or more of the article receiving openings 62. The sidewalls 50, 52, 54, 56 adjacent the divider 60 will help prevent the remaining silverware items from falling off the divider 60. The user may then shake the remaining silverware items such that the remaining silverware items are randomly received by the article receiving openings 62. The protrusions 70*a*, 70*b* will help divide the handle portions of the silverware items from nesting together. At the same time, the protrusions 30 of the article support wall 20 will help segregate the working portion of the silverware to further inhibit nesting of silverware items. Thus, by loading the working portion of the silverware downward into the second interior area portion 42*b* of the article basket 10, only the handle of the silverware extends upward through the article receiving openings 62. The working portion of the silverware therefore will not come into contact with human hands during unloading and remains sanitary after washing. Moreover, sharp points or other edges are hidden within the second interior area portion 42*b* of the basket to inhibit, such as prevent, injury to a user reaching into the dishwasher compartment area. Mugs, cups or other beverage containers may then be inverted an rested on the upper surface of the divider 60 while handles from the supported articles are received within the supported beverage containers. The dishwashing cycle is then carried out wherein the second conical surface 27*b* directs jet streams of dishwashing fluid up through the openings 22 of the article support wall 20 to wash the spaced apart articles and any mugs, cups or other beverage containers being supported by the article basket 10. After the washing cycle, the rinse fluid drains off the spaced apart articles and is drawn away from the tips of the articles by way of the first and second conical surfaces 27*a*, 27*b* of the openings 22. Once the drying cycle is complete, a user may unload the mugs, cups or other beverage containers and then grasp the handles of the silverware items. The silverware items may then be sorted and stored, for example in a utensil tray, without the need to touch the working portions of the silverware.

It will be appreciated that the article baskets 10 herein provide are flexible, multipurpose, customizable, easy to use, and enhance sanitization and safety. Indeed, the working portion (e.g., scoop portion of the spoon, tines of a fork, blade of a knife, etc.) of the silverware is received in the first interior area portion 42*a* of the article basket 10. When washing is complete, the user will tend to grab the handle, not the working portion, so sanitization concerns are addressed. Moreover, safety concerns are addressed. Indeed, since the working portion is hidden within the first interior area portion 42*a*, sharp points or edges are isolated to inhibit, such as prevent, injury to a user reaching into the dishwasher compartment area. Still further, the divider 60 including article receiving openings 62 and protrusions 70*a*, 70*b* simplify loading of silverware items since a handful of silverware items may be simply dropped into the article basket 10 for random sorting and spacing, rather than individually inserting the silverware items one at a time. Furthermore, a divider 60 may be incorporated to provide stacked washing of articles on top of the silverware.

From the above description of the invention, those skilled in the art will perceive improvements, changes and modifications. Such improvements, changes and modifications within the skill of the art are intended to be covered by the appended claims.

What is claimed is:

1. An article basket adapted to support articles within a dishwashing machine comprising:

an article support wall configured to support articles extending within an interior area of the basket, the article support wall provided with a plurality of openings extending through the article support wall, each of the openings is defined by an edge extending along a path circumscribing substantially the entire opening, and the edge of each of the openings is concave in a direction facing the opening along substantially the entire path, wherein the openings are configured to permit permeation of fluid through the article support wall while inhibiting passage of support articles through the article support wall; and at least one side wall extending from the article support wall and a divider configured to extend over an opening into the interior area of the basket, the divider including a plurality of article receiving openings configured to receive a portion of an article being inserted into the interior area of the basket, wherein each of the article receiving openings includes at least two protrusions that each extend along a distinct axis such that none of the protrusions are aligned with another of the protrusions along the same axis, wherein at least two of the protrusions extend in opposite directions from opposed sides of the article receiving opening and only partially extend across the article receiving opening, and wherein the spaced protrusions provide seating locations along the article receiving opening between the protrusions.

2. The article basket of claim 1, wherein each of the paths comprises a circular path.

3. The article basket of claim 1, wherein the plurality of openings are arranged as a matrix of openings along a plurality of opening row paths and a plurality of opening column paths that are substantially perpendicular to the opening row paths.

4. The article basket of claim 3, wherein the article support wall comprises a plurality of protrusions that each extends in a direction towards the interior area of the basket, wherein the protrusions are arranged as a matrix of protrusions along a plurality of protrusion row paths and a plurality of protrusion column paths that are substantially perpendicular to the protrusion row paths.

5. The article basket of claim 4, wherein the matrix of protrusions is arranged with respect to the matrix of openings such that each protrusion row path extends between a pair of adjacent opening row paths and each protrusion column path extends between a pair of adjacent opening column paths.

6. The article basket of claim 1, wherein the article support wall comprises a plurality of protrusions extending in a direction towards the interior area of the basket.

7. The article basket of claim 6, wherein each of the plurality of protrusions comprises a substantially hemispherical protrusion.

8. The article basket of claim 1, wherein each opening is provided with at least one conical surface circumscribing substantially the entire opening.

9. The article basket of claim 8, wherein the at least one conical surface comprises a first conical surface facing towards the interior area of the basket and a second conical surface facing away from the interior area of the basket.

10. An article basket adapted to support articles within a dishwashing machine comprising:

an article support wall configured to support articles extending within an interior area of the basket, the article support wall provided with a plurality of openings extending through the article support wall, each of the openings is defined by an edge extending along a path circumscribing substantially the entire opening, and the edge of each of the openings is concave in a direction facing the opening along substantially the entire path, wherein the openings are configured to permit permeation of fluid through the article support wall while inhibiting passage of support articles through the article support wall; and at least one side wall including an elongated slot and a single divider including a portion configured to be selectively laterally inserted into the elongated slot to divide the interior area into a first interior area portion and a second interior area portion, the divider being selectively insertable into and removable out of the elongated slot and wherein the first interior area portion is defined by the article support wall, the at least one side wall and the divider, and wherein the second interior area portion is defined by four vertical sidewalls and the divider while being open to an article insertion opening opposite the divider, and the divider including a plurality of article receiving openings configured to receive a portion of an article being inserted from the second interior area portion to the first interior area portion.

11. An article basket for supporting articles within a dishwashing machine comprising:

at least one side wall at least partially defining an interior area of the basket and including an elongated slot; and a single divider including a portion configured to be selectively laterally inserted into the elongated slot to divide the interior area into a first interior area portion and a second interior area portion, the divider being selectively insertable into and removable out of the elongated slot and wherein the second interior area portion is defined by four vertical sidewalls and the divider while being open to an article insertion opening opposite the divider, and the divider including a plurality of article receiving openings configured to receive a portion of an article being inserted from the second interior area portion to the first interior area portion.

12. The article basket of claim 11, wherein the four vertical sidewalls include a support structure configured to support a portion of the divider.

13. The article basket of claim 11, wherein the four vertical sidewalls comprise a first side wall, a second side wall spaced from the first side wall to define a width of the basket, a third side wall, and a fourth side wall spaced from the third side wall to define a length of the basket, wherein the elongated slot is defined in the first side wall.

14. The article basket of claim 13, wherein the elongated slot extends along substantially the entire length of the basket.

15. An article basket for supporting articles within a dishwashing machine comprising:

at least one side wall at least partially defining an interior area of the basket; and a divider configured to extend over an opening into the interior area of the basket, the divider including a plurality of article receiving openings configured to receive a portion of an article being inserted into the interior area of the basket, wherein each of the article receiving openings includes at least two protrusions that each extend along a distinct axis such that none of the protrusions are aligned with another of the protrusions along the same axis, wherein at least two of the protrusions extend in opposite directions from opposed sides of the article receiving opening and only partially extend across the article receiving opening, and wherein the spaced protrusions provide seating locations along the article receiving opening between the protrusions.

16. The article basket of claim 15, wherein the plurality of article receiving openings are arranged as a matrix of article receiving openings along a plurality of row paths and a plurality of column paths that are substantially perpendicular to the row paths.

17. The article basket of claim 15, wherein each protrusion extends across less than about 50% of a length of the article receiving opening.

18. The article basket of claim 15, wherein each protrusion comprises a substantially V-shaped profile.

19. The article basket of claim 15, wherein the at least one side wall includes an elongated slot, and the divider includes a portion configured to be selectively inserted into the elongated slot to divide the interior area into a first interior area portion and a second interior area portion.

20. The article basket of claim 15, further comprising an article support wall configured to support articles extending within the interior area of the basket, the article support wall being provided with a plurality of openings extending through the article support wall, wherein the openings are configured to permit permeation of fluid through the article support wall, wherein the article support wall comprises a plurality of protrusions extending in a direction towards the interior area of the basket.

21. The article basket of claim 20, wherein the plurality of openings are arranged as a matrix of openings along a plurality of opening row paths and a plurality of opening column paths that are substantially perpendicular to the opening row paths, and the plurality of protrusions are arranged as a matrix of protrusions along a plurality of protrusion row paths and a plurality of protrusion column paths that are substantially perpendicular to the protrusion row paths, wherein the matrix of protrusions is arranged with respect to the matrix of openings such that each protrusion row path extends between a pair of adjacent opening row paths and each protrusion column path extends between a pair of adjacent opening column paths.

* * * * *